United States Patent [19]

Gioello

[11] 4,451,934

[45] Jun. 5, 1984

[54] RIBBED VENTILATING UNDERGARMENT FOR PROTECTIVE GARMENTS

[76] Inventor: Debbie A. Gioello, 237 Van Cortlandt Park Ave., Yonkers, N.Y. 10705

[21] Appl. No.: 312,173

[22] Filed: Oct. 16, 1981

[51] Int. Cl.[3] ..... A41B 9/06

[52] U.S. Cl. ..... 2/113; 2/DIG. 1

[58] Field of Search ..... 2/113, DIG. 1, 109, 2/81, 243 A, 159, 227, 175, 102, 108, 95; 112/417; 428/398

[56] References Cited

U.S. PATENT DOCUMENTS

| | | | |
|---|---|---|---|
| 2,462,361 | 2/1949 | Cassens | 2/DIG. 1 |
| 2,610,496 | 9/1952 | Kostopoulos | 2/113 |
| 3,122,754 | 3/1964 | Wedin | 2/113 |
| 3,474,465 | 10/1969 | Artzt | 2/113 |
| 4,195,364 | 1/1980 | Bengtsson et al. | 2/DIG. 1 |

FOREIGN PATENT DOCUMENTS

| | | | |
|---|---|---|---|
| 23887 | 11/1955 | Fed. Rep. of Germany | 2/DIG. 1 |

*Primary Examiner*—Doris L. Troutman
*Attorney, Agent, or Firm*—Charles E. Temko

[57] ABSTRACT

A garment and accessories formed substantially entirely of textile fabric having a series of parallel raised ribs at generally equally spaced intervals to form channels through which air may circulate and which also serves to maintain a distance when the garment is worn beneath a non-porous outergarment such as personal body armour worn by law enforcement and military personnel, asbestos clothing worn by foundry workers, rubberized garments for work and recreation, and the like. In one embodiment, the ribs are formed by stitching a fabric-enclosed fiberfill cord of substantial diameter, using a knit stitch formation which causes or allows the base fabric to enclose approximately seven eighths to three quarters of the circumference of the cord thereby eliminating any lateral shifting of the cords when the garment is worn under tension. When the wearer moves in any direction the undergarment maintains the supple, pliable and flexible properties of the base fabric which enclose the cords. In another embodiment, the cord is self-encased and appliqued to one surface of the fabric using a blind stitch which attaches the cords to the base fabric at spaced intervals. The cords do not shift and the properties remain the same as the fabric in the firstmentioned embodiment. The garments may be constructed or designed for the upper and/or lower torso in the form of vests, sleeved or sleeveless shirts, jackets, pants or trousers, and for the extremities as accessories such as mittens, leg coverings, cod pieces, hat liners and the like.

9 Claims, 10 Drawing Figures

FIG.4
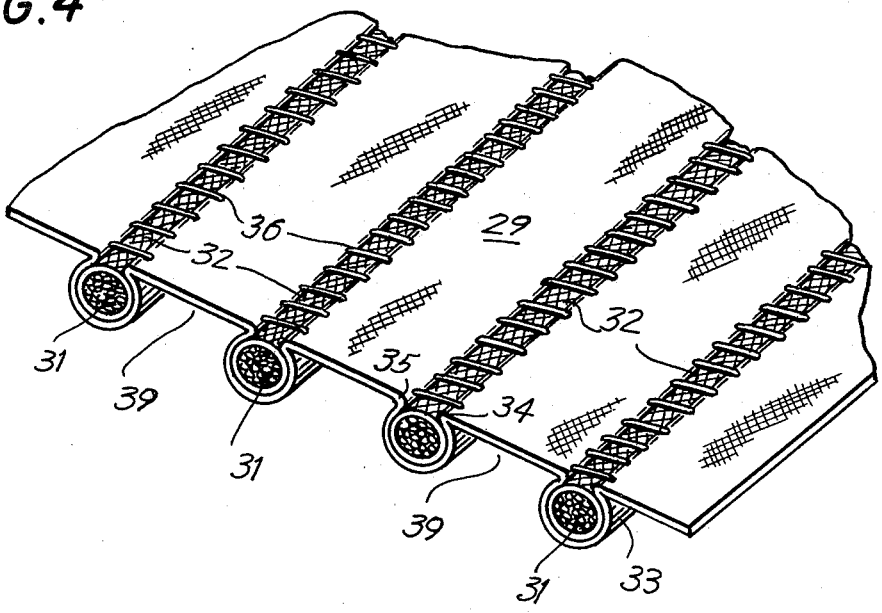
FIG.5
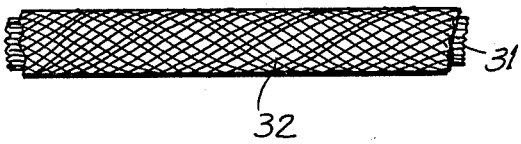
FIG.6
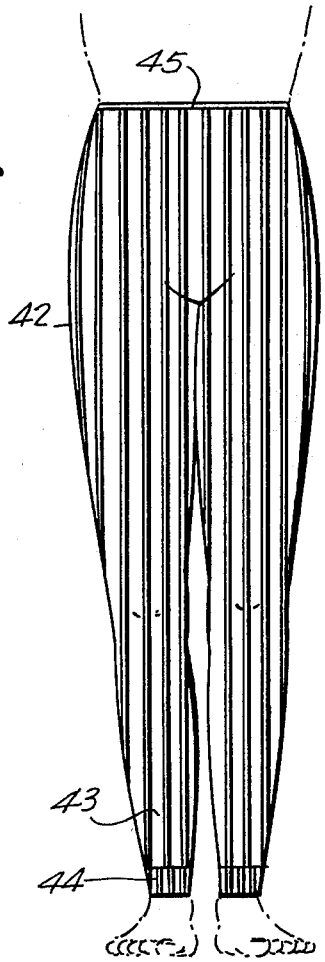
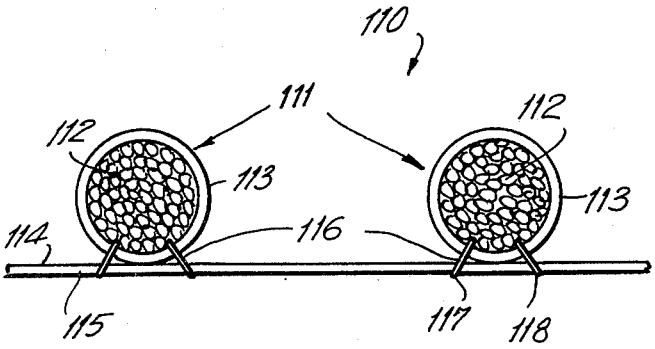
FIG.7

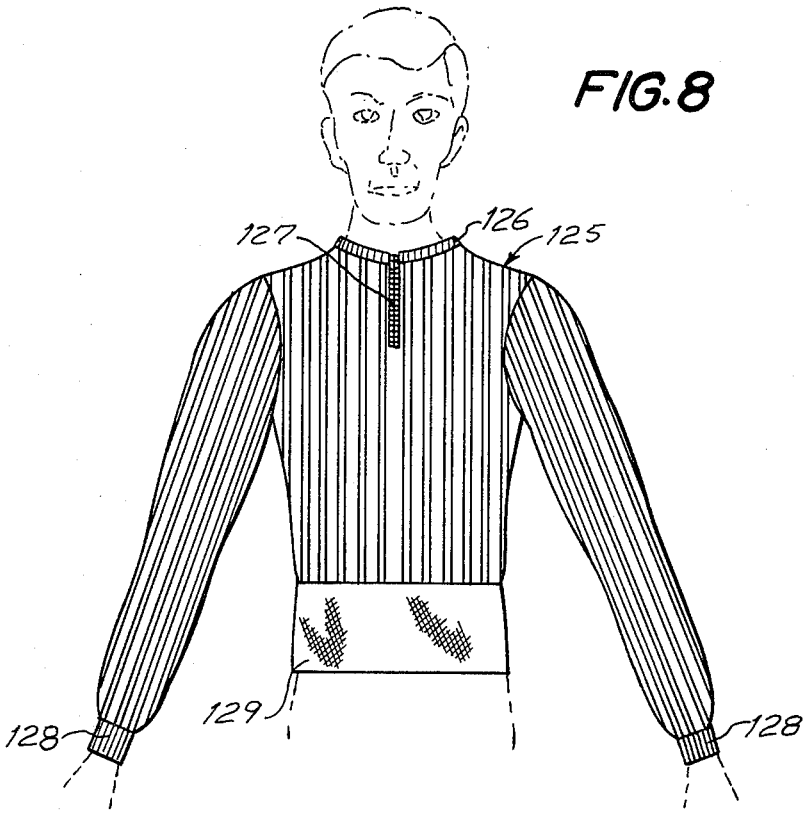
FIG. 8
FIG. 9
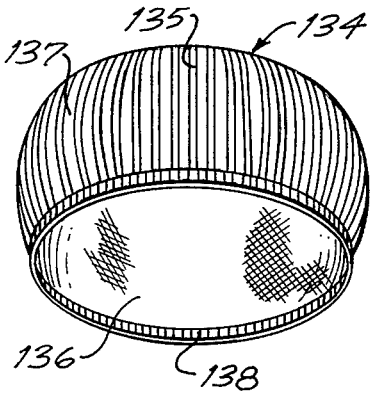
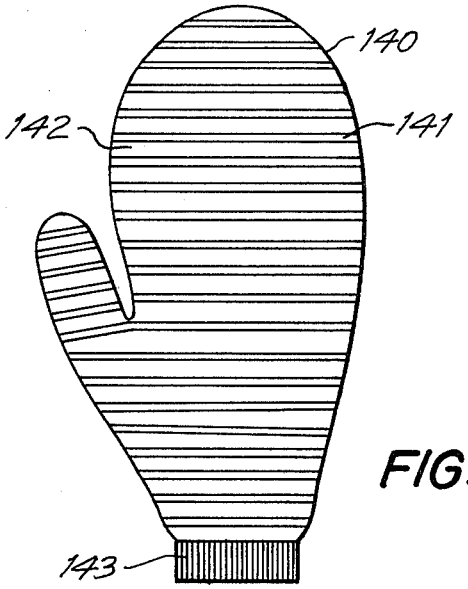
FIG. 10

RIBBED VENTILATING UNDERGARMENT FOR PROTECTIVE GARMENTS

BACKGROUND OF THE INVENTION

This invention relates generally to the field of undergarments and more specifically to an improved form suitable for use with outergarments of a non-porous nature such as personal body armour for law enforcement and military personnel, workers exposed to excessive heat temperatures resulting from machines, furnaces, industrial and commercial processes, firefighters and gear used in deep-sea diving, asbestos or rubberized protective suits and the like.

The principal problem encountered in wearing garments of this type lies in the non-porosity of the fabric used in the construction of the outergarments. During extended period of stress, emotional and mental tension resulting from prolonged and intensive exposure to excessive heat developed from personal or job-related activities, environment and high humidity, the strength and energy of an individual can be drained causing fatigue and decreased performance due to body heat retention. Since the principal problem encountered in using garments of this type lies in the non-porosity of the fabric, normal heat and moisture and perspiration from those areas of the skin of the wearer underlying the garment is neither absorbed nor transmitted through the garment to the ambient air. As a result, even during relatively cool temperatures, the wearer becomes uncomfortable after a relatively short period following the donning of the garment.

Another problem is that the outergarment, being made of non-porous and/or metallic fabric may chafe, abrade or irritate the skin. The ribs of the undergarment maintain a distance of one sixteenth to one inch between the under and outergarments which will prevent the outergarment from coming in contact with the skin of the wearer.

SUMMARY OF THE INVENTION

Briefly stated, the invention contemplates the provision of an improved undergarment particularly suited for wear under a non-porous garment of the types described hereinabove, which will provide both an absorptive and evaporative function, so that perspiration of the wearer may be both removed and vented to the ambient air on a continuous basis during use.

To this end, the described embodiments are contoured fairly close to the configuration of the wearer and are fabricated from knitted or woven materials having substantial moisture absorptive qualities. The fabric, prior to tailoring is provided with a series of substantially equally spaced parallel ribs formed by incorporating a number of generally cylindrical fiberfill cords. In the preferred embodiment, the fabric-enclosed cords are surrounded by the knitted or woven material for approximately seven eighths to three quarters of the cylindrical periphery thereof, the remaining part of the area being bridged by a knit stitch configuration made with elastic yarns or by the applique of cords to the base fabric. When the garment is placed in tension, as when worn, the ribs resist any tendency to roll or flatten because of the manner in which the cord is interconnected. When the non-porous outergarment is positioned upon the undergarment there are formed a plurality of elongated air conducting channels approximately two inches wide and one sixteenth to one inch high, due to the ribs formed by the enclosed cording which prevent the outergarment from coming in contact with the wearer, and further improve cooling through the ventilations created by the air channels resulting from the parallel raised rib cords. Perspiration absorbed through the surface of the undergarment adjacent the skin of the wearer is transmitted to the opposite surface thereof between the ribs where it is driven outward of the channels through normal convection to be vented to the ambient atmosphere.

BRIEF DESCRIPTION OF THE DRAWINGS

In the drawings, to which reference will be made in the specification, similar reference characters have been employed to designate corresponding parts throughout the several views.

FIG. 4 is a second view in perspective thereof showing an opposite side.

FIG. 5 is a view in elevation showing a cording element forming a part of the embodiment.

FIG. 6 is a view in elevation showing a second embodiment of the invention.

FIG. 7 is an end elevational view of a second embodiment of the invention.

FIG. 8 is a front elevational view of a third embodiment of the invention.

FIG. 9 is a perspective view showing a fourth embodiment of the invention.

FIG. 10 is an elevational view showing a fifth embodiment of the invention.

DETAILED DESCRIPTION OF THE DISCLOSED EMBODIMENTS

Figure 1:
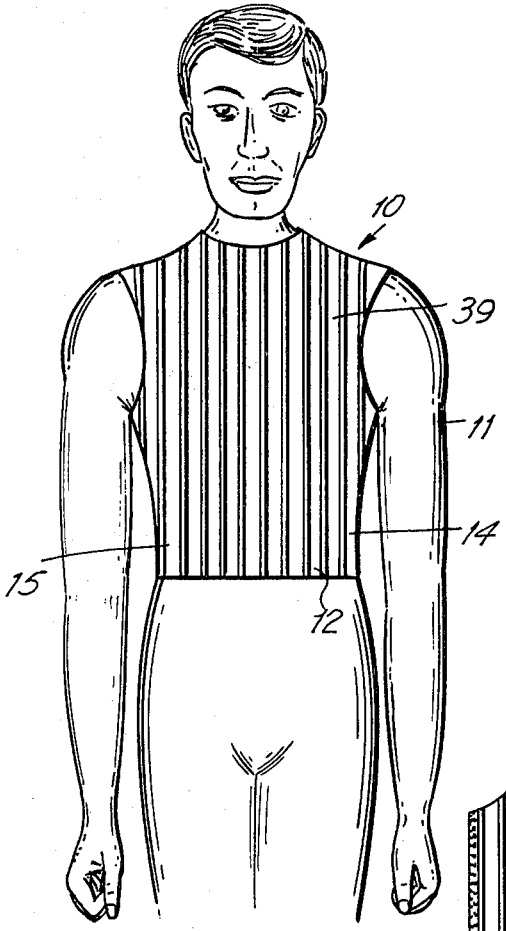
FIG. 1 is a front elevational view of an embodiment of the invention shown in position upon a wearer.
Figure 2:
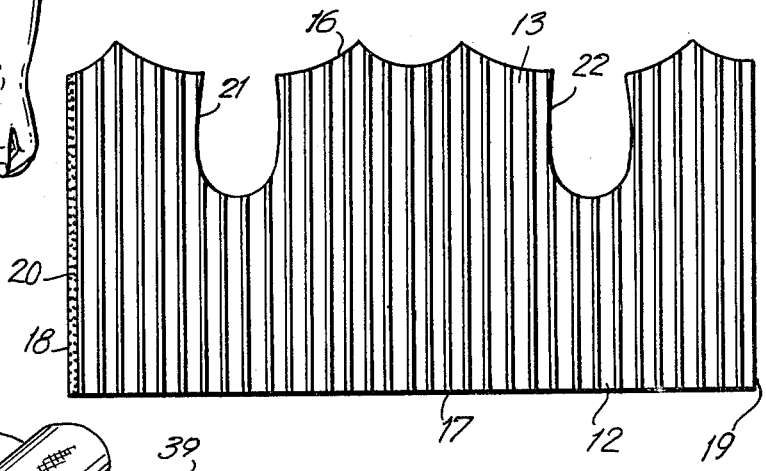
FIG. 2 is a view in elevation showing the embodiment in flattened or developed condition.

In accordance with the invention, the first embodiment thereof, generally indicated by reference character 10, is illustrated in FIG. 1 in position upon a wearer 11. It may be formed of a single blank of material 12 (FIG. 2) to include a back panel 13, and first and second front panels 14 and 15. The blank 12 is bounded by an upper bound edge 16, a lower bound edge 17, and vertical front edges 18 and 19 preferably provided with hook and pile interconnecting means 20 of a type commonly sold under the trademark VELCRO. The arm scyes 21 and 22 are also preferably with bound edges.

Figure 3:
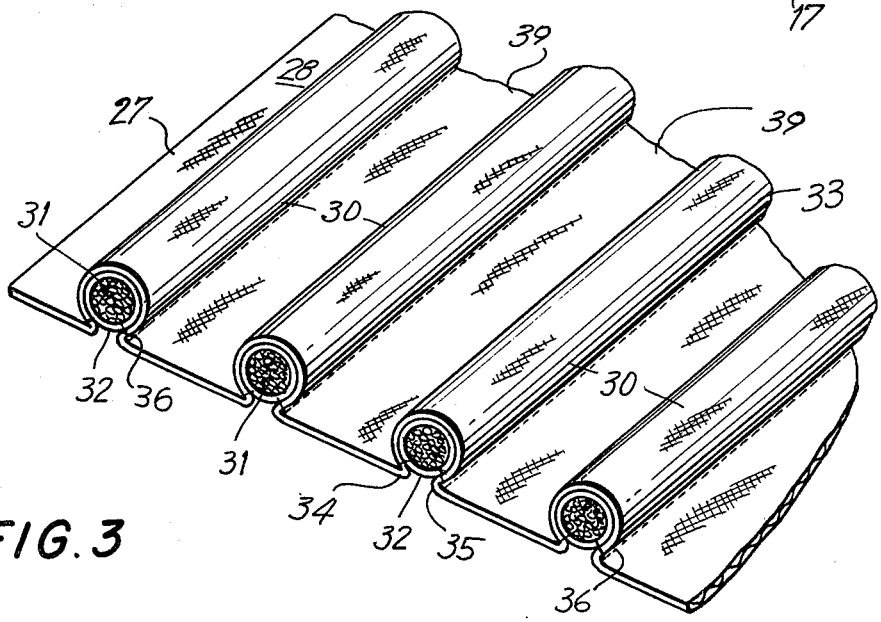
FIG. 3 is a perspective view of a piece of fabric employed in the construction of the embodiment.

Referring to FIGS. 3 and 4, reference character 27 indicates a piece of knit or woven material used in forming the garment 10. It is preferably of a relatiavely high percentage of natural fiber, so as to have a relatively high moisture absorptive capability. It is bounded by an outer surface 28 and an inner surface 29 (FIG. 4). Parallel ribs 30 are formed using a fiberfill cord 31 (FIG. 5) preferably encased in a closely woven or closely knitted jacket 32 which prevents the unraveling of the same during fabrication, wear and care. The cords 31 are positioned in arcuate portions 33 of the fabric which overlie approximately seven eighths of the outer surface of the cords, and form fold edges 34 and 35 in spaced parallel relationship. The edges 34–35 are interconnected by an elongated chain stitch 36 which overlies the remaining one quarter of the outer surface of the cord 31. By placing the fold edges 34–35 in spaced parallel relation, when the garment is under tension, this tension is transmitted to the knit stitch configuration which effectively negates any tendency for the ribs to roll from their proper position.

When the device 10 is worn, the outermost surfaces of the ribs 30 contact the inner surface of the outergarment, and thus form passages 39, at least one end of which communicates with an upper or lower edge of a body covering panel. Most conveniently, this will be at the waist level of the wearer or along the neck and/or shoulders. At such locations, the ends of the channels can easily communicate with the ambient atmosphere, and as the wearer perspires, moisture is absorbed by the textile material to be transmitted to the channels where normal convection provides a substantially continuous flow of air tending to vaporize the perspiration and conduct it outwardly of the garment. In this regard, the garment serves as a wick, constantly absorbing perspiration from the skin of the wearer and transmitting it to the channels, vaporization being aided by normal body heat emanating from the skin of the wearer, and further improves cooling through the ventilations created by the air channels resulting from the parallel raised rib cords.

In the second embodiment, illustrated in FIG. 6 in the drawings, the same concepts are applied to a pair of trousers 42, in which the channels 43 commence at the ankles 44 and terminate at the waist 45 of the wearer.

It is not inconceivable that due to the nature of the finished outergarment, it would be desirale to construct the undergarment with ribs in a horizontal position or with the ribs intersecting with each other at varying angles to form rectangularly-shaped or rhomboid-shaped pockets rather than channels. This construction as for example in a mitten may be useful in the case where the undergarment or outergarment need not vent air flow.

Another advantage in the case of wearing the undergarment beneath personal body armour, where the spacings are sufficiently small, lies in the fact that the ribs can absorb some of the momentum of an impinging projectile, and reduce or prevent bruising to the underlying body of the wearer.

Turning now to the second embodiment of the invention, generally indicated by reference character 110, it differs from the principal embodiment in that the ribs 111, are fully enclosed fiberfill cords. They include an inner core 112 of fiberfill material, and an outer casing 113. The cords are attached to the outer surface 114 of the fabric 115 by blind stitching 116 along parallel rows 117 and 118, sufficiently spaced to prevent rolling of the ribs 111 with respect to the fabric with movement of the wearer.

Turning now to the third embodiment of the invention, generally indicated by reference character 125 (FIG. 8), the garment is of sleeved type having a neck band 126 with fly front 127, knitted cuffs 128 and a knitted waistband 129 without ribs which may be disposed below the belt of the wearer, this band keeping the garment in position while wearing, and providing for air to circulate upwardly therefrom through the channels formed by the ribs.

It is also possible to provide a garment similar to that shown in FIG. 8 in which the sleeves, collar and waistband are of woven rather than rib knitted material to be worn as a regulation shirt beneath body armor, the exposed portions of the shirt presenting a conventional appearance.

The embodiment illustrated in FIG. 9 is in the form of a hatliner 134, including a main body 135 having an opening 136. Channels 137 communicate with a knit band 138 for venting.

The embodiment shown in FIG. 10, and generally indicated by reference character 140 is in the form of a mitten, the main body portion 141 of which is provided with transverse channels 142 to allow for flexing when manipulating the hands, a knit cuff 143. However, because of the nature of the flexing of the mitten, and the stiffness of the outer mitten, usually of asbestos, normally worn with the mitten, the outer mitten will on frequent occasion part contact with the ribs, and thus trapped moisture will escape at that time.

It may thus be seen that I have invented novel and highly useful improvements in ribbed venting undergarments which are particularly adapted to be worn beneath protective clothing in substantial comfort and safety.

I wish it to be understood that I do not consider the invention limited to the precise details of structure shown and set forth in this specification, for obvious modifications will occur to those skilled in the art to which the invention pertains.

I claim:

1. An improved undergarment for use in conjunction with the wearing of a relatively moisture impervious outergarment comprising at least one body covering panel; said panel being formed of a porous textile material having a substantial ability to absorb moisture, said panel having a plurality of raised generally parallel ribs extending from at least one surface thereof and forming channels therebetween for the conduction of moisture vapor therealong when said undergarment is worn by a user beneath said outergarment; said innergarment having free edges thereof which are disposed at substantial angles with respect to the principal axes of at least some of said ribs, whereby at least some of said channels are positioned during the wearing of the undergarment to communicate with the ambient atmosphere.

2. An undergarment in accordance with claim 1, further characterized in said ribs being formed by interconnecting with said textile a generally cylindrically shaped cord of fiberfill material.

3. The improvement in accordance with claim 2, further characterized in said cords being surrounded by a surface of said textile material over approximately three quarters of the surface of said cord, said textile material forming a pair of fold edges interconnected by threaded means across the remaining one quarter of said surface.

4. An undergarment in accordance with claim 1, further characterized in said ribs being generally vertically arranged when said undergarment is worn, whereby air flow within said chambers rises by normal convection.

5. An undergarment in accordance with claim 1, further characterized in said undergarment being in the form of a vest in which the ribs thereof are vertically arranged thereon.

6. An undergarment in accordance with claim 1, further characterized in said garment being in the form of a pair of trousers in which the ribs thereon are vertically arranged.

7. An undergarment in accordance with claim 2, further characterized in said cords being encased in a separate wrapper of textile material, and interconnected to a surface of said panel by a pair of substantially parallel rows of applique stitching.

8. An undergarment in accordance with claim 1, further characterized in said garment being in the form of a hatliner in which the ribs communicate at one end thereof with a circular opening.

9. An undergarment in accordance with claim 1, further characterized in said garment being in the form of a mitten in which the ribs are transversely arranged with respect to the axis of the mitten, and in which the channels communicate with a knit cuff at the wrist thereof during the manual flexing of the mitten.

* * * * *